US009638192B2

(12) United States Patent
Fischer et al.

(10) Patent No.: US 9,638,192 B2
(45) Date of Patent: May 2, 2017

(54) FUEL PUMP

(75) Inventors: Matthias Fischer, Datterode (DE); Bernd Jaeger, Fritzlar (DE); Zlatko Penzar, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 888 days.

(21) Appl. No.: 13/516,618

(22) PCT Filed: Dec. 9, 2010

(86) PCT No.: PCT/EP2010/069241

§ 371 (c)(1),
(2), (4) Date: Aug. 14, 2012

(87) PCT Pub. No.: WO2011/082930

PCT Pub. Date: Jul. 14, 2011

(65) Prior Publication Data

US 2012/0301289 A1 Nov. 29, 2012

(30) Foreign Application Priority Data

Dec. 16, 2009 (DE) ..... 10 2009 058 672
Jan. 12, 2010 (DE) ..... 10 2010 004 379

(51) Int. Cl.
*F04D 5/00* (2006.01)
*F02M 59/12* (2006.01)

(52) U.S. Cl.
CPC ..... *F04D 5/008* (2013.01); *F02M 59/12* (2013.01)

(58) Field of Classification Search
CPC ..... F04D 5/00; F04D 5/008; F04D 29/42; F02M 59/12; F05B 2240/12
See application file for complete search history.

(56) References Cited

U.S. PATENT DOCUMENTS 5,011,367 A * 4/1991 Yoshida ..... F02M 37/048 415/55.1
5,486,087 A 1/1996 Treiber et al.
5,498,124 A 3/1996 Ito et al.
(Continued)

FOREIGN PATENT DOCUMENTS

AT 109 069 3/1928
AT 109 069 B 3/1928
(Continued)

*Primary Examiner* — Nathaniel Wiehe
*Assistant Examiner* — Jason Davis
(74) *Attorney, Agent, or Firm* — Cozen O'Connor

(57) ABSTRACT

A fuel pump, including a driven impeller, which rotates in a pump housing and on the two sides comprises guide blades that each delimit a ring of blade chambers, and further including partial ring-shaped channels, which are arranged on both sides in the region of the guide blades in the pump housing and which form delivery chambers with the blade chambers for delivering fuel, wherein an inlet channel leads into the one delivery chamber and the other delivery chamber leads into an outlet channel, and mutually opposing blade chambers are connected to each other. The cross-sectional surface of the partial ring-shaped channel arranged on the inlet side decreases toward the end of the partial ring-shaped channel to zero. The region in which the cross-sectional surface decreases extends over an angular region of more than 45°.

9 Claims, 2 Drawing Sheets

(56) References Cited

U.S. PATENT DOCUMENTS

| | | | | |
|---|---|---|---|---|
| 6,068,456 | A | 5/2000 | Tuckey et al. | |
| 6,152,687 | A * | 11/2000 | Wilhelm et al. | 415/55.1 |
| 6,527,506 | B2 * | 3/2003 | Pickelman | F04D 5/002 415/55.1 |
| 7,121,786 | B2 | 10/2006 | Yonehara | |
| 7,766,604 | B2 * | 8/2010 | Honda et al. | 415/55.4 |
| 2004/0071542 | A1 | 4/2004 | Yu et al. | |
| 2004/0208763 | A1 * | 10/2004 | Yu | F04D 5/002 417/423.1 |
| 2007/0274846 | A1 | 11/2007 | Deubner et al. | |
| 2009/0074559 | A1 * | 3/2009 | Inuzuka | F04D 5/002 415/55.1 |

FOREIGN PATENT DOCUMENTS

| | | | |
|---|---|---|---|
| CN | 1383474 | | 12/2002 |
| DE | 43 43 078 | | 6/1995 |
| DE | 43 43 078 | A1 | 6/1995 |
| DE | 196 43 728 | | 4/1998 |
| DE | 199 04 560 | | 8/1999 |
| DE | 199 04 560 | A1 | 8/1999 |
| JP | 62-120078 | | 7/1987 |
| JP | 64-025494 | | 2/1989 |
| JP | 06-288381 | | 10/1994 |
| JP | 2001- 59398 | | 6/2001 |
| JP | 2004-060470 | | 2/2004 |
| JP | 2006-526110 | | 11/2006 |
| WO | WO 2005/038259 | | 4/2005 |
| WO | WO 2005/038259 | A1 | 4/2005 |

* cited by examiner

FUEL PUMP

CROSS REFERENCE TO RELATED APPLICATIONS

This is a U.S. national stage of application No. PCT/EP2010/069241, filed on 9 Dec. 2010. Priority is claimed on German Application No.: 10 2009 058 672.5 filed 16 Dec. 2009; and German Application No.: 10 2010 004 379.6 filed 12 Jan. 2010, the contents of which are incorporated here by reference.

BACKGROUND OF THE INVENTION

1. Field of the Invention

The subject matter of the invention is a fuel pump comprising a driven impeller that rotates in a pump housing and has, on its sides, guide vanes that delimit a ring of vane chambers, partial ring-shaped ducts arranged on both sides in the region of the guide vanes in the pump housing and which form, with the vane chambers, and delivery chambers for delivering the fuel. An inlet duct opens into the one delivery chamber, and the other delivery chamber opens into an outlet duct, and vane chambers which lie opposite one another are connected to one another.

2. Description of Prior Art

Such fuel pumps according to the principle of a side duct pump are used to deliver fuel from a fuel container to an internal combustion engine of a motor vehicle and are therefore known. When the impeller wheel rotates, the fuel is drawn in via the inlet duct and raised to a relatively high pressure level as the fuel passes through the partial ring-shaped ducts. At the end of the partial ring-shaped ducts, which can extend over an angular region of 300° to 330°, the fuel is delivered, via the outlet duct and the electric motor of the fuel pump, to a supply line that conducts the fuel to the internal combustion engine. The guide vanes in the delivery chambers generate in this context a circulation flow which runs transversally with respect to the direction of movement of the guide vanes and which exits in the radially outer region of the guide vane and enters the partial ring-shaped duct, flows from the radial outer side to the radial inner side in the partial ring-shaped duct, leaves the partial ring-shaped duct radially on the inside and enters a vane chamber of the impeller again radially on the inner side. Half the circulation flow is therefore distributed to the partial ring-shaped duct and half to the vane chambers. The partial ring-shaped ducts end in the region of the outlet duct. While the outlet-side duct merges to a greater or lesser extent with the outlet duct, the inlet-side duct decreases its cross-sectional area to zero. This decreasing of the cross-sectional area usually occurs over an angular range of up to 40°. A disadvantage with these fuel pumps is that they generate a considerable noise level, which is disruptive, in particular when mounted in a fuel container of a motor vehicle.

SUMMARY OF THE INVENTION

One embodiment of the invention is based on providing a fuel pump with significantly reduced noise emissions, wherein the fuel pump is to be cost-effective to manufacture.

According to one embodiment of the invention, a fuel pump having a cross-sectional area of its partial ring-shaped duct, arranged on the inlet side, decreases to zero by an end of the partial ring-shaped duct, wherein the region in which the cross-sectional area decreases extends over an angular range of more than 45°.

It has been found that in the case of a reduction in the cross-sectional area the circulation flow over a short angular range has too little time to follow the changing cross section and to change position, which is responsible for a considerable portion of the noise emissions of a fuel pump. By extending the region of the partial ring-shaped duct with the decreasing cross-sectional area over an angular range of more than 45°, a long run-out zone of the partial ring-shaped duct arranged on the inlet side is created. As a result of this, this region has a small positive gradient. Owing to this elongated region, the circulation flow has more time to change position from the partial ring-shaped duct into the vane chambers of the impeller and into the partial ring-shaped duct lying opposite with the outlet duct. This brings about a reduction in the noise emissions of the fuel pump. The advantage here is that this configuration of the duct requires virtually no additional effort. No increased effort in terms of manufacture is involved irrespective of whether the duct geometry in the pump lid of the pump housing is generated by machining or by shaping, since the use of other working programs or other work piece forms is cost-neutral.

A sufficiently gentle positive gradient of the partial ring-shaped duct with an associated decrease in the cross-sectional area is achieved with an angular range from 70° to 150°, in particular of 90°. With this configuration, the circulation flow has sufficient time to change position.

In one particularly simple refinement, the partial ring-shaped duct is configured in the region with the decreasing cross-sectional area such that the cross-sectional area decreases uniformly. This means that the gradient of the partial ring-shaped duct is linear.

According to another advantageous refinement, the region with the decreasing cross-sectional area is formed by two sub-regions, wherein the cross-sectional area decreases to a greater extent in the first sub-region than in the second sub-region. This ensures that in the first sub-region the circulation flow is influenced to a greater extent, with the associated increase noise emissions, but these are produced to a significantly smaller extent than is known in the prior art. In contrast, in the second sub-region the circulation flow is influenced to a particularly small degree. As a result, the circulation flow is additionally stabilized. In addition, as a result of this configuration of the critical region, with respect to the length of the partial ring-shaped duct, is moved away from the end of the partial ring-shaped duct. This is significant insofar as at the end of the partial ring-shaped duct the wiper starts, which in each case connects the end and the start of the partial ring-shaped ducts and therefore the outlet and inlet to one another, and the region of the wiper is also a region of noise emissions.

The two sub-regions are of particularly simple design if the decrease in the cross-sectional area occurs uniformly, and therefore respectively linearly, in both sub-regions.

A junction between the two sub-regions in the form of a bend is avoided in another refinement by virtue of the fact that the two sub-regions merge into one another continuously, with the result that the duct base of the partial ring-shaped duct approximates in a convex-like fashion to the impeller with respect to the length of the two sub-regions.

The junction between the partial ring-shaped duct in the region in which the cross-sectional area decreases can be embodied either as a bend or continuously. In the latter case, a concave design of the junction is therefore produced.

BRIEF DESCRIPTION OF THE DRAWINGS

The invention will be explained in more detail using a plurality of exemplary embodiments, in which.

DETAILED DESCRIPTION OF THE PREFERRED EMBODIMENTS

Figure 1:
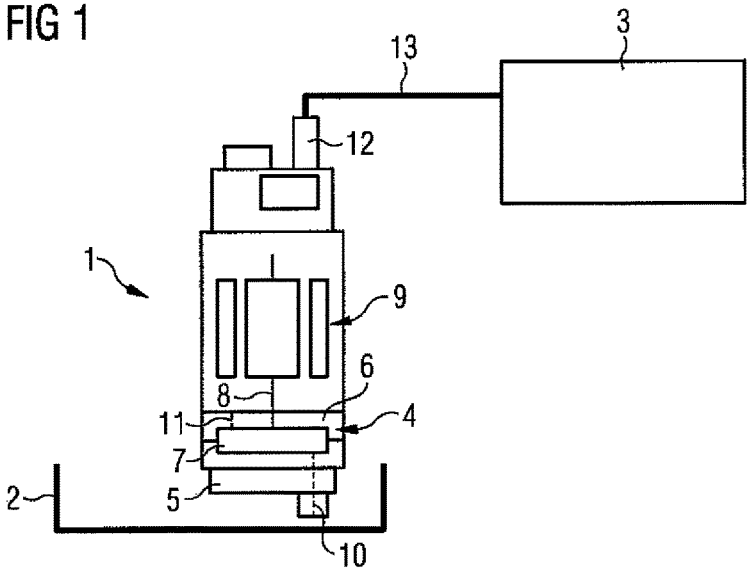
FIG. 1 is a fuel pump according to the invention.

FIG. 1 shows a fuel pump 1 for delivering fuel from a fuel container 2 of a motor vehicle to an internal combustion engine 3. The fuel pump 1 has a pumping stage with a pump housing 4, which is composed of a pump lid 5 and a pump base 6 also referred to a pump floor 6. An impeller 7 is arranged in the pump housing. The impeller 7 is driven by a shaft 8 of an electric motor 9. The fuel which is drawn in from the fuel container 2 by the pumping stage via an inlet duct 10 is delivered to an outlet 12 via an outlet duct 11 and the electric motor 9. From said outlet 12, the fuel passes to the internal combustion engine 3 via a supply line 13.

Figure 2:
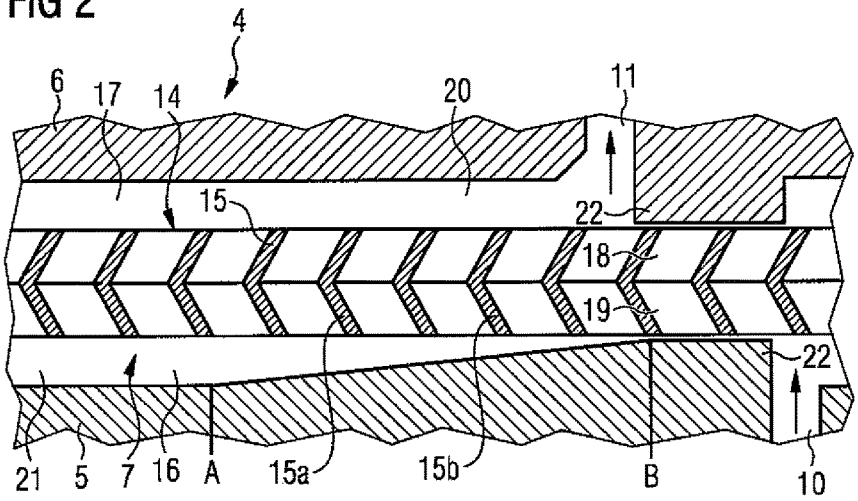
FIG. 2 is a schematic sectional illustration of the pump housing.

FIG. 2 shows part of the pump housing 4 with the pump lid 5, the pump base 6 and the impeller 7. The impeller 7 has a ring 14 of vanes 15, 15*a*, 15*b* on each of its two sides, wherein two vanes 15, 15*a*, 15*b* respectively bound a vane chamber 18, 19. The pump housing 4 has, in the region of the vanes 15, 15*a*, 15*b*, a partial ring-shaped duct 16, 17 on each of its two sides. The partial ring-shaped ducts 16, 17 form, together with the vane chambers 18, 19, delivery chambers 20, 21. Half of the delivery chambers 20, 21 are apportioned here to partial ring-shaped ducts 16, 17 and half to the vane chambers 18, 19, which lie opposite the respective partial ring-shaped duct 16, 17. The partial ring-shaped ducts 16, 17 start in the region of the inlet duct 10 and end in the region of the outlet duct 11 after an angular range of approximately 330°. A wiper 22 adjoins the end of the partial ring-shaped ducts 16, 17 with respect to the rotational direction of the impeller 7, said wiper 22 being arranged between the outlet duct 11 and the inlet duct 10. While the partial ring-shaped duct 17 in the pump floor 6 has a constant cross-sectional area over wide parts of its extent, the partial ring-shaped duct 16 in the pump lid 5 has at its end a region 23 with a decreasing cross-sectional area. This region is delimited by the letters A and B in the FIG. 2. This region extends over an angular range of 90°, wherein even relatively large angular ranges of, for example, 110° may be possible. The cross-sectional area decreases constantly over the profile of the region 23, with the result that a linear profile of the duct base is produced.

Figure 3:
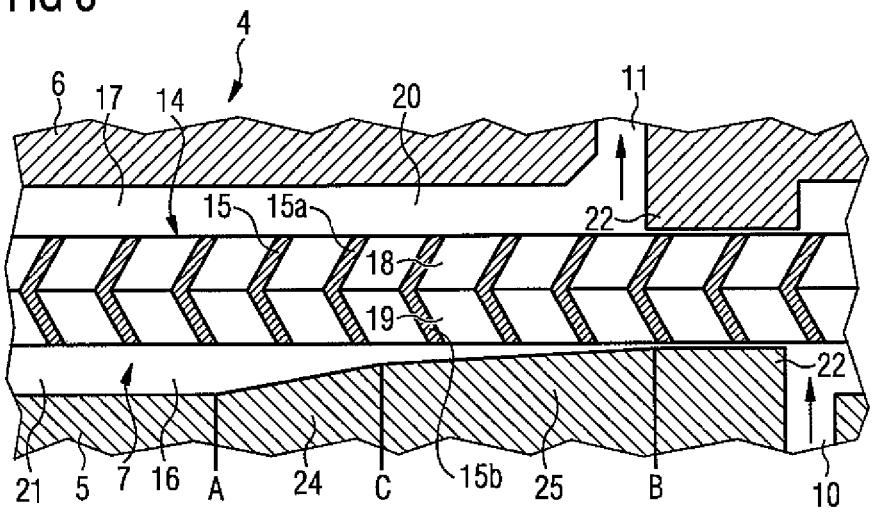
FIGS. 3-4 are further embodiments of the pump housing.

FIG. 3 shows a second embodiment which differs from the fuel pump according to FIG. 2 only in the design of the region 23. The region is divided into two sub-regions 24, 25, wherein the first sub-region 24 has a greater reduction in the cross-sectional area than the second sub-region 25. The first sub-region therefore extends over an angular extent of 30°, while the second sub-region 25 extends over 60°. The two sub-regions 24, 25 each have a linearly extending duct base here. However, it is also conceivable for the two sub-regions 24, 25 to be constructed with equal lengths.

Figure 4:
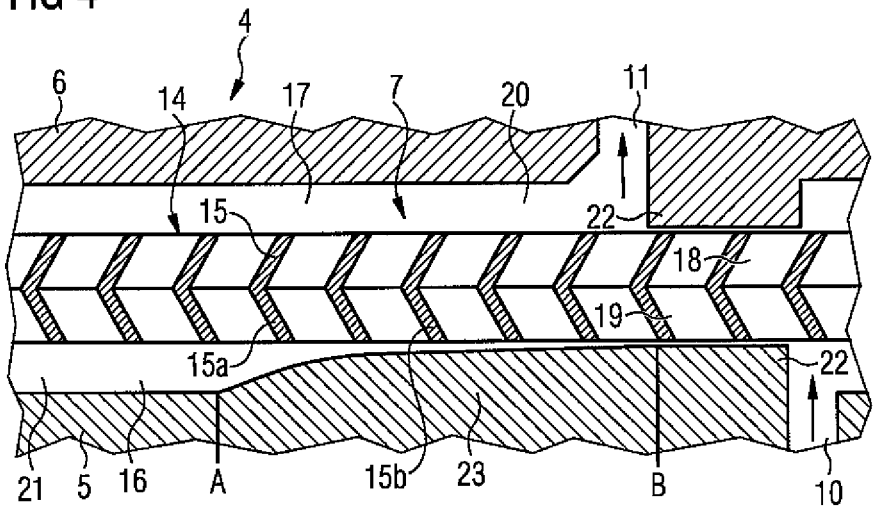

A further embodiment is shown by FIG. 4. The duct base in the region 23 curves convexly in the direction of the impeller 7, wherein the curvature is most pronounced at the start of the region 23 with respect to the rotational direction of the impeller 7. The junction between the partial ring-shaped duct 17 and the region 23 is embodied in the form of a bend at the point A. However, it is also conceivable to make the junction continuous and therefore concave.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A fuel pump comprising:

a pump housing;

a driven impeller that rotates in the pump housing having guide vanes that delimit a ring of vane chambers between opposite axial sides of the driven impeller;

partial ring-shaped ducts in the pump housing arranged facing the opposite axial sides of the driven impeller in a region of the guide vanes that form respective delivery chambers for delivering fuel with the vane chambers that lie opposite one another and are connected to one another bounded by respective wipers;

a first inlet duct of the pump housing that opens into one delivery chamber, and an outlet duct that opens into the other delivery chamber;

wherein a cross-sectional area of the partial ring-shaped duct arranged on the inlet side is constant in a first region proximate to the first inlet duct and decreases to zero by an end of the partial ring-shaped duct at a point that corresponds with one of the respective wipers that at least partially defines the outlet duct, a second region with the decreasing cross-sectional area is formed by two sub-regions, each sub-region having a respective slope, wherein the cross-sectional area decreases to a greater extent in a first sub-region than in a second sub-region, the second sub-region arranged downstream of the first sub-region, wherein the slope in the first sub-region is steeper than the slope in the second sub-region, and wherein the region in which the cross-sectional area decreases extends over an angular range of more than 45° and less than 150°, measured from the outlet duct.

2. The fuel pump as claimed in claim 1, wherein the angular range is between 70° to 150°.

3. The fuel pump as claimed in claim 2, wherein the angular range is 90°.

4. The fuel pump as claimed in claim 2, wherein an angular range of the first sub-region is 30°.

5. The fuel pump as claimed in claim 2, wherein an angular range of the second sub-region is 60°.

6. The fuel pump as claimed in claim 1, wherein the cross-sectional area decreases linearly in both sub-regions.

7. The fuel pump as claimed in claim 1, wherein the two sub-regions merge with one another continuously.

8. A fuel pump as claimed in claim 2, comprising:

a pump housing;

a driven impeller that rotates in the pump housing having guide vanes that delimit a ring of vane chambers between opposite axial sides of the driven impeller;

partial ring-shaped ducts in the pump housing arranged facing the opposite axial sides of the driven impeller in a region of the guide vanes that form respective delivery chambers for delivering fuel with the vane chambers that lie opposite one another and are connected to one another bounded by respective wipers;

a first inlet duct of the pump housing that opens into one delivery chamber, and an outlet duct that opens into the other delivery chamber;

wherein a cross-sectional area of the partial ring-shaped duct arranged on the inlet side is constant in a first region proximate to the first inlet duct and decreases to zero by an end of the partial ring-shaped duct at a point that corresponds with one of the respective wipers that at least partially defines the outlet duct, a second region with the decreasing cross-sectional area is formed by two sub-regions, each sub-region having a respective base wherein the cross-sectional area decreases to a greater extent in a first sub-region than in a second sub-region, the second sub-region arranged downstream of the first sub-region, wherein a duct base in the first sub-region curves convexly in the direction of the impeller, and wherein the region in which the cross-sectional area decreases extends over an angular range of more than 45° and less than 150°, measured from the outlet duct.

9. The fuel pump as claimed in claim 8, wherein the angular range is between 70° to 150°.

* * * * *